137-13 SR
C6306 XR 4,248,692

United States Patent [19]
Knebel et al.
[11] 4,248,692
[45] Feb. 3, 1981

[54] PROCESS FOR THE DISCHARGE OF ASH CONCENTRATE FROM A COAL DEASHING SYSTEM

[75] Inventors: Alfred H. Knebel; Donald E. Rhodes, both of Oklahoma City, Okla.

[73] Assignee: Kerr-McGee Chemical Corporation, Oklahoma City, Okla.

[21] Appl. No.: 70,563

[22] Filed: Aug. 29, 1979

[51] Int. Cl.[3] ..... C10G 1/00; C10G 9/12; C10G 7/00

[52] U.S. Cl. ..... 208/8 LE; 208/48 R; 201/2; 196/122; 137/240

[58] Field of Search ..... 202/241, DIG. 1; 201/2; 196/122; 137/240, 15; 15/406; 134/20, 22 C, 166 C, 169 C; 208/48 R, 8 LE; 423/659

[56] References Cited

U.S. PATENT DOCUMENTS

| | | | |
|---|---|---|---|
| 2,934,489 | 4/1960 | Canevari | 208/48 R |
| 3,015,619 | 1/1962 | Wimmer et al. | 208/48 R |
| 3,174,924 | 3/1965 | Clark et al. | 208/48 R |
| 3,416,598 | 12/1968 | Dorn | 208/48 R |
| 3,607,717 | 9/1971 | Roach | 208/8 LE |
| 3,843,744 | 10/1974 | Kramer et al. | 208/48 R |
| 3,964,976 | 6/1976 | Pettrey, Jr. et al. | 208/48 R |
| 3,996,063 | 12/1976 | Worley et al. | 134/22 C |
| 4,090,958 | 5/1978 | Leonard | 208/8 LE |
| 4,097,366 | 6/1978 | Tanaka et al. | 208/48 R |
| 4,135,982 | 1/1979 | Green | 201/12 |

FOREIGN PATENT DOCUMENTS

| | | | |
|---|---|---|---|
| 957396 | 5/1964 | United Kingdom | 208/48 R |

*Primary Examiner*—O. R. Vertiz
*Assistant Examiner*—Gary P. Straub
*Attorney, Agent, or Firm*—William G. Addison

[57] ABSTRACT

A process for removing an agglomerate of accumulated materials including ash concentrate which collects within the first heavy phase withdrawal conduit of a coal deashing system employing solvent at elevated temperatures and pressures near the critical temperature of the solvent. A carrier fluid is introduced into the first heavy phase withdrawal conduit simultaneously with or after pressure reduction of the heavy phase under conditions such that a turbulent flow profile is developed within the withdrawal conduit which results in the removal of at least a substantial portion of any accumulated materials within the withdrawal conduit.

10 Claims, 3 Drawing Figures x137/13
T2039R
X2045W
X2021D

PROCESS FOR THE DISCHARGE OF ASH CONCENTRATE FROM A COAL DEASHING SYSTEM

BACKGROUND OF THE INVENTION

1. Field of the Invention

This invention relates to a process for producing a continuous discharge of coal products from a coal deashing system utilizing particular solvents while operating at elevated pressures and at temperatures near the critical temperature of the solvents.

2. Description of the Prior Art

Heretofore, coal has been mixed with certain solvents at elevated temperatures and pressures to produce mixtures of dissolved and undissolved coal. Various systems have been proposed for separating the dissolved coal from the undissolved coal.

In U.S. patent application Ser. No. 973,876 filed Dec. 28, 1978 and assigned to the same assignee as the present invention, an improved system is disclosed for effecting such separation.

In that system, a feed mixture comprising soluble coal products, solvent and insoluble coal products is separated in a first separation zone maintained at an elevated temperature and pressure into a first light fraction and a first heavy fraction comprising insoluble coal products and some solvent. The first heavy fraction also includes a small quantity of relatively low melting point soluble coal products such as coal tars that are dissolved in the solvent. The insoluble coal products comprise the undissolved coal, mineral matter, other solid inorganic particulate matter and other such matter which is insoluble in the solvent solution under the operating conditions of the process.

The first heavy fraction is withdrawn from the first separation zone and the pressure level is reduced at least about 100 psig. and preferably at least about 500 psig. to vaporize the solvent and yield the insoluble coal products in a relatively dry, powdery form referred to as ash concentrate. Upon the vaporization of the solvent from the first heavy phase, the formerly soluble coal tars and the like separate and collect upon the interior surface of the withdrawal conduit. Since this material is at a temperature near to or above its melting point, it exhibits a highly viscous behavior and can, upon contacting the relatively dry ash concentrate, cause the ash concentrate to adhere thereto and form an agglomerate which will block the withdrawal conduit. The formation of such a blockage requires termination of process operation to permit removal of the agglomerate. A tedious and expensive cleanout then is required to restore operation.

It would be desirable to provide a method by which the blockage problem associated with the withdrawal of the first heavy fraction from the first separation zone can be alleviated.

SUMMARY OF THE INVENTION

It has been discovered that the first heavy fraction comprising insoluble coal products separated in a first separation zone in a coal deashing process utilizing solvent at elevated pressures and temperatures near the critical temperature of the solvent can be recovered as a relatively dry powdery composition in a continuous manner by the introduction of a carrier fluid into the withdrawal conduit following the pressure reduction.

To alleviate the tendency of the ash concentrate composition to form an agglomerate and to collect within the withdrawal conduit, a carrier fluid is introduced into the withdrawal conduit after the pressure reduction means under conditions such that a turbulent flow profile is developed within the withdrawal conduit which results in the removal of at least a substantial portion of any accumulated materials such as coal tars within the withdrawal conduit.

DESCRIPTION OF THE PREFERRED EMBODIMENT

In the practice of the invention disclosed in U.S. patent application Ser. No. 973,876 filed Dec. 28, 1978, the disclosure of which is incorporated herein by reference, a feed mixtue (comprising soluble coal products, insoluble coal products and solvent) is passed from a mixing zone through a conduit into a first separation zone maintained at an elevated temperature and pressure. In the first separation zone, the feed mixture is separated into a first heavy fraction and a first light fraction. The first light fraction is withdrawn and passed into a second separation zone. The first heavy fraction is withdrawn from the first separation zone and the pressure is reduced at least 100 psig. to yield a relatively dry, powdery ash concentrate composition.

Figure 1:
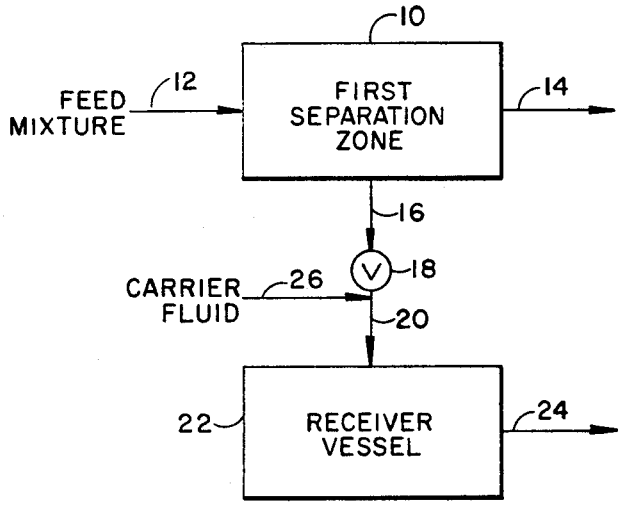
FIG. 1 is a schematic, diagrammatic illustration of the process of this invention.

Turning now to FIG. 1 of the present invention, a feed mixture (comprising soluble coal products, insoluble coal products and solvent) enters a first separation zone 10 by a conduit 12. Sufficient solvent is present in the feed mixture to provide a ratio by weight of solvent to soluble coal products and insoluble coal products of from about 1:1 to about 10:1. It is to be understood that larger quantities of solvent can be present, however, such quantities are not required. The temperature level in the first separation zone 10 is maintained at a temperature level below about 700 degrees F. and at a pressure level in the range of from about the critical pressure of the deashing solvent to about 1000 psig. to effect the separation. Preferably, the first separation zone 10 is maintained at a temperature in the range of from about 400 degrees F. to below about 700 degrees F. and at a pressure level in the range of from about 700 psig. to about 1000 psig.

In the first separation zone 10, the feed mixture separates into a first light fraction comprising soluble coal products and solvent and a first heavy fraction comprising insoluble coal products and some solvent. The first heavy fraction also includes a small quantity of relatively low melting point soluble coal products such as coal tars that are dissolved in the solvent.

The first light fraction is withdrawn from the first separation zone 10 by a conduit 14 for subsequent processing (not shown).

The first heavy fraction is withdrawn from the first separation zone 10 through a conduit 16 and is passed through a pressure reduction means 18, such as for example, a pressure reduction valve. During passage of the first heavy fraction through the pressure reduction means 18, the pressure level of the first heavy fraction is reduced at least 100 psig. Preferably, the pressure level of the first heavy fraction is reduced at least 500 psig. The pressure reduction flashes the first heavy fraction to form one stream comprising solvent and one stream comprising the insoluble coal products now referred to as ash concentrate which pass together through a transfer conduit 20 to enter a receiver vessel 22. The ash concentrate is collected in receiver vessel 22 and the solvent is withdrawn from vessel 22 by a conduit 24 for re-utilization in preparing additional feed mixture.

The distance traversed by conduits 16 and 20 can be minimal, or the length of either or both of the conduits 16 or 20 can be substantial, that is, over several feet.

In some instances it has been found that the small quantity of soluble coal products which are dissolved or otherwise entrained within the heavy phase may separate therefrom and form a deposit on the interior surface of transfer conduit 20 or receiver vessel 22. Since this material has a relatively low melting point, the coating that is formed is highly adhesive and tends to cause any particles of ash concentrate which it comes into contact with to adhere thereto and form an agglomerate. The agglomeration can result in the complete blockage of transfer conduit 20 and subsequent blockage of the pressure reduction means 18. The blockage results in the termination of the discharge of the first heavy fraction from the first separation zone 10 and may result in the ultimate termination of the deashing process operation.

It now has been discovered that the discharge of the first heavy fraction from the first separation zone can be achieved in a continuous manner, when it would otherwise block, by introducing a carrier fluid into the transfer conduit 20 through a conduit 26 under conditions such that a turbulent flow profile is developed within the transfer conduit. While the specific mechanism is unclear, it is believed that injection of the carrier fluid effects a removal of the coal tars or other materials which may separate from the solvent and form a deposit upon the interior surface of the conduit 20 or a receiver vessel 22 by a combination of partial distillation and turbulent purging. The carrier fluid may comprise, for example, superheated steam, hydrocarbon fluids such as methane, ethane, propane, butane, pentane, or hexane, noble gases or inert gases such as nitrogen or carbon dioxide or similar gases or liquids. Preferably the carrier fluid comprises superheated steam.

Figure 2:
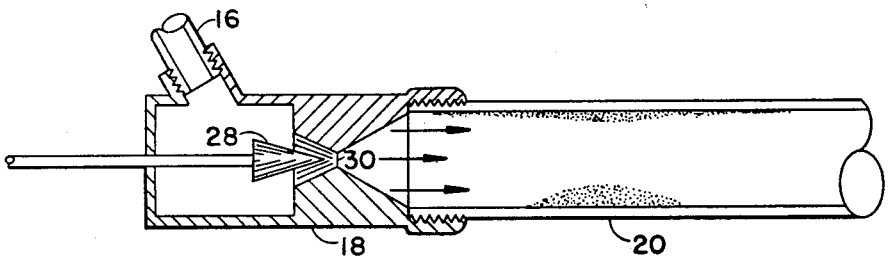
FIG. 2 is an illustration of a particular withdrawal conduit-pressure reduction means configuration in which a blockage is forming.

Turning now to FIG. 2, a particular withdrawal conduit-pressure reduction means configuration is illustrated. The first heavy fraction enters the pressure reduction means 18 through conduit 16. The first heavy phase then passes by a needle valve 28 to exit through an opening 30 contained in pressure reduction means 18. The first heavy fraction separates upon passage through pressure reduction means 18 to form at least a gaseous phase comprising solvent and a solid phase comprising powdery ash concentrate, both of which are withdrawn through conduit 20. As previously indicated, the first heavy fraction also includes some dissolved soluble coal products. Upon pressure reduction, the soluble coal products separate from the gaseous solvent and collect upon the inner surface of conduit 20. In that the soluble coal products have a relatively low melting point, that is, in the range of from about 200 to about 400 degrees F., the coating that is formed is highly adhesive and tends to cause particles of ash concentrate to adhere thereto and form an agglomerate. The agglomerated mass continues to increase in size through the build-up of additional soluble coal products and ash concentrate until conduit 20 becomes blocked. A blockage of conduit 20 also can cause opening 30 in pressure reduction means 18 to become blocked with the agglomerate. Blockage of either or both pressure reduction means 18 and conduit 20 requires process termination to permit removal of the agglomerate.

Figure 3:
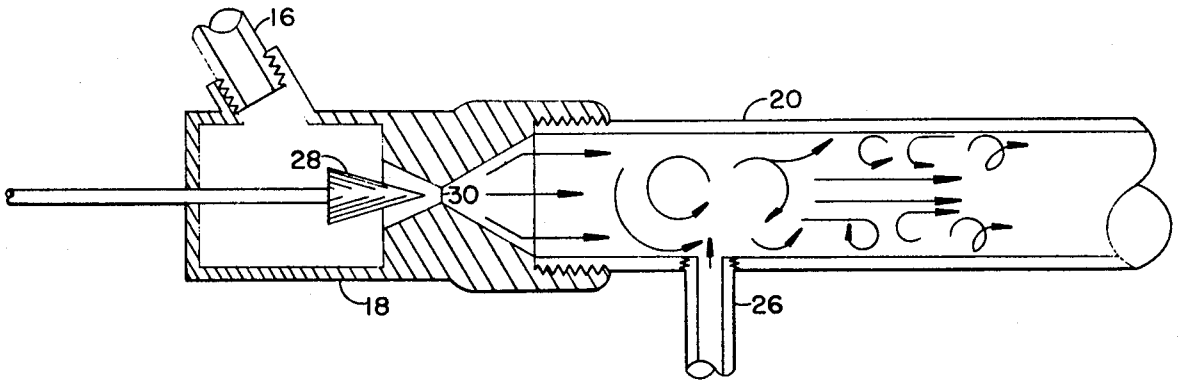
FIG. 3 is an illustration of the withdrawal conduit-pressure reduction means configuration employing the present invention.

Turning now to FIG. 3, the withdrawal conduit-pressure reduction means configuration is illustrated in accordance with the present invention. As illustrated, when the first heavy fraction passes through opening 30 in pressure reduction means 18, a carrier fluid is introduced through conduit 26 into the separated gaseous solvent and ash concentrate contained in conduit 20. The carrier fluid is introduced under such conditions that a turbulent flow profile is developed within conduit 20. The turbulent flow of the carrier fluid tends to remove at least a portion of any soluble coal products which collect upon the interior surface of conduit 20. This minimizes the formation of any agglomerate buildup within conduit 20.

The carrier fluid can be introduced into the mixture of solvent and ash concentrate simultaneously with the pressure reduction or thereafter within the conduit 20 wherever deposition is found to occur. Preferably, the carrier fluid is introduced into the mixture of gaseous solvent and ash concentrate after pressure reduction. Such operation permits the carrier fluid to be introduced into conduit 20 at a substantially lower pressure than would be required to effect removal of the agglomerate buildup if the carrier fluid was injected simultaneously with pressure reduction.

To further illustrate the present invention and not by way of limitation, a feed mixture comprising 3 parts of benzene to one part of coal liquefaction products comprising soluble coal products and insoluble coal products is introduced into the first separation zone. The first separation zone is maintained at a temperature of about 550 degrees F. and a pressure of about 800 psig. to effect a separation of the feed mixture into a light fraction and a heavy fraction. The heavy fraction is withdrawn and passed through a pressure reduction means similar to that illustrated in FIGS. 2 and 3. The withdrawal conduit plugs with an agglomerate comprising soluble coal products and ash concentrate after a short period of continuous operation. The process operation is discontinued and pressure reduction means 18 and conduit 20 are removed cleaned and reassembled. Process operation then is resumed with the addition of superheated steam, as a carrier fluid, introduced through conduit 26 into conduit 20 as illustrated in FIG. 3. The steam is superheated to about 500 degrees F. prior to entry into conduit 20. No substantial buildup of agglomerate is found to form within conduit 20 during further continuous operation.

The foregoing results clearly demonstrate the effectiveness of the present invention in alleviating the blockage problem associated with the withdrawal of the first heavy fraction from the first separation zone.

In the process described above, the term "solvent" means a fluid consisting essentially of at least one substance having a critical temperature below 800 degrees F. selected from the group consisting of: aromatic hydrocarbons having a single benzene nucleus and normal boiling points below about 310 degrees F., such as benzene, toluene, o-, m- and p-xylene, ethyl benzene, isopropyl benzene and monocyclic aromatic hydrocarbons in general having normal boiling points below about 310 degrees F.; cycloparaffin hydrocarbons having normal boiling points below about 310 degrees F., such as cyclobutane, cyclopentane, cyclohexane, cycloheptane and nonaromatic monocyclic hydrocarbons in general having normal boiling points below about 310 degrees F.; open chain mono-olefin hydrocarbons having normal boiling points below about 310 degrees F., such as butene, pentene, hexene and heptene; open chain saturated hydrocarbons having normal boiling points below about 310 degrees F., such as pentane, hexane and heptane; mono-, di, and tri-open chain amines containing from about 2–8 carbon atoms, such as ethyl, propyl, butyl, pentyl, hexyl, heptyl, and octyl amines; carbocyclic amines having a monocyclic structure containing from about 6–9 carbon atoms, such as aniline and its alkyl homologs; heterocyclic amines containing from about 5–9 carbon atoms, such as pyridine and its alkyl homologs; and phenols containing from about 6–9 carbon atoms and their homologs. Such fluids and their usefulnes is described further in U.S. Pat. Nos. 3,607,716 and 3,607,717 the disclosures of which are incorporated herein be reference.

The term "soluble coal products" means the constituents of the feed that are soluble in the deashing solvent under the conditions of this invention.

The term "insoluble coal products" means undissolved coal, mineral matter, other solid inorganic particulate matter and other such matter which is insoluble in the deashing solvent under the conditions of this invention.

The term "ash concentrate" means the insoluble coal product composition which has been separated from the soluble coal products and the solvent removed therefrom.

While the present invention has been described with respect to what at present is considered to be the preferred embodiment thereof, it is to be understood that changes or modifications can be made in the process without departing from the spirit or scope of the invention as defined by the following claims.

What is claimed is:

1. In a process for separating a feed mixture comprising soluble coal products, insoluble coal products and a solvent in a separation zone, said solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs, in which said feed mixtures is maintained in said separation zone at an elevated temperature and pressure to separate said feed mixture into a light fraction and into a heavy fraction comprising insoluble coal products and some solvents including some soluble coal products present therein and in which withdrawing said heavy fraction from said separation zone and reducing the pressure level of said heavy fraction at least about 100 psig. results in a deposition of said soluble coal products dissolved in said solvent in said heavy fraction upon the interior surface of a withdrawal conduit through which said heavy phase is passed, the improvement which comprises:

introducing a separate stream of carrier fluid, inert with respect to materials present in said heavy fraction under conditions within the withdrawal conduit, into said withdrawal conduit under such conditions that a turbulent flow profile is formed by at least said stream of said carrier fluid within said withdrawal conduit to prevent or substantially minimize the deposition of or effect removal of any accumulated soluble coal products by contact with said carrier fluid.

2. The process of claim 1 wherein the elevated temperature and pressure is defined further as:

a temperature level in the range of from about 400 degrees F. to about 700 degrees F. and a pressure level in the range of from about the critical pressure of the solvent to about 1000 psig.

3. The process of claim 1 wherein the pressure reduction is defined further as:

reducing the pressure level of the heavy fraction at least about 500 psig.

4. The process of claim 1 wherein the carrier fluid comprises at least one member selected from the group consisting of said solvent, superheated steam, nitrogen, carbon dioxide, and noble gases.

5. The process of claim 1 wherein the carrier fluid comprises superheated steam.

6. The process of claim 1 wherein the carrier fluid comprises at least one hydrocarbon fluid selected from the group consisting of methane, ethane, propane, butane, pentane and hexane.

7. The process of claim 1 wherein the carrier fluid comprises an inert gas.

8. The process of claim 1 wherein the carrier fluid comprises a noble gas.

9. The process of claim 1 wherein the introduction of the carrier fluid into said withdrawal conduit is after pressure reduction of said heavy fraction and at or before the region in which deposition normally would occur.

10. The process of claim 9 wherein the introduction of said carrier fluid and said pressure reduction of said heavy phase are co-located.

* * * * *

UNITED STATES PATENT OFFICE

CERTIFICATE OF CORRECTION

PATENT NO. : 4,248,692

DATED : February 3, 1981

INVENTOR(S) : Alfred H. Knebel and Donald E. Rhodes

It is certified that error appears in the above-identified patent and that said Letters Patent are hereby corrected as shown below:

The assignee should be Kerr-McGee Corporation.

Signed and Sealed this

*Twenty-first* Day of *April 1981*

[SEAL]

*Attest:*

RENE D. TEGTMEYER

*Attesting Officer* *Acting Commissioner of Patents and Trademarks*